United States Patent [19]

Worrallo

[11] 4,274,614

[45] Jun. 23, 1981

[54] LOCKING DEVICE AND THE LIKE

[76] Inventor: Anthony C. Worrallo, 15 Sprott Rd., Auckland 5, New Zealand

[21] Appl. No.: 909,264

[22] Filed: May 24, 1978

[51] Int. Cl.[3] ..... A47G 29/02

[52] U.S. Cl. ..... 248/243

[58] Field of Search ..... 248/73, 243, 246, 295 A; 403/279, 282

[56] References Cited

U.S. PATENT DOCUMENTS

| | | | |
|---|---|---|---|
| 2,692,109 | 10/1954 | Schmidt | 248/246 |
| 2,883,137 | 4/1959 | Weber | 248/243 |
| 3,429,540 | 2/1969 | Worrallo | 248/246 |
| 3,812,976 | 5/1974 | Rempel | 248/314 X |
| 4,013,253 | 3/1977 | Perrault | 248/243 X |
| 4,040,588 | 8/1977 | Papsco et al. | 248/245 |
| 4,156,515 | 5/1979 | Mochly | 248/246 |

FOREIGN PATENT DOCUMENTS

| | | | |
|---|---|---|---|
| 523862 | 4/1956 | Canada | 248/246 |
| 1303172 | 7/1962 | France | 248/246 |
| 363138 | 8/1962 | Switzerland | 248/246 |

*Primary Examiner*—William H. Schultz

*Attorney, Agent, or Firm*—Roylance, Abrams, Berdo & Farley

[57] ABSTRACT

A locking structure comprising a channel and a bracket. The channel has a pair of lips defining an elongated mouth. The bracket is L-shaped having a horizontal limb and a vertical limb extending downwardly from one end of the horizontal limb. The bracket has a neck the lower end of which merges with said vertical limb. The neck extends obliquely upwardly from said vertical limb and has a locking formation at its free end. The locking formation is wider than the neck and projects laterally on each side of the neck. The neck can pass through the mouth. When the bracket is so positioned with the neck passing through the mouth, the laterally projecting parts of the locking formation engage one face of each lip. The external surface of the vertical limb engages the other face of each lip. Said one face of each lip is formed with deformable serrations which extend in the direction of elongation of the mouth.

9 Claims, 7 Drawing Figures

LOCKING DEVICE AND THE LIKE

This invention relates to a locking device which provides a positive metal to metal lock. It is common in locking devices using a metal to metal lock to be provided with a secondary lock in the form of a nut and bolt and the like to hold the lock in the engaged position and to reduce problems caused through wear or minimum tolerance factors. I have found that these disadvantages are overcome by providing serrations on the rearward facing surfaces of the lips of the support member. I have further found that crushing during the locking action is restricted to the said serrations and prevents bruising of the outer visible faces of the lips of the support device.

According to the present invention there is provided a locking structure comprising a bracket and an element on which the bracket can be mounted, the element including a pair of laterally spaced lips which define a mouth therebetween, and the bracket having a main portion and a neck protruding from the main portion, the dimensions of the neck being such that it can pass through said mouth, there being a locking formation carried by the free end of the neck and extending laterally of the neck on each side thereof, the dimensions of the locking formation, transversely of the neck, being greater than the width of said mouth and the locking formation being intended to abut one face of each lip when the neck is in the position in which it passes through the mouth, said main portion having a surface which, when said neck is passed through said mouth and said locking formation is brought into abutting relationship with said one face of each lip, abuts the other face of each lip, said one face of each lip being formed with longitudinally extending serrations the peaks of which are engaged by said locking formation.

For a better understanding of the present invention, and to show how the same may be carried into effect, reference will now be made, by way of example, to the accompanying drawings in which.

Figure 1:
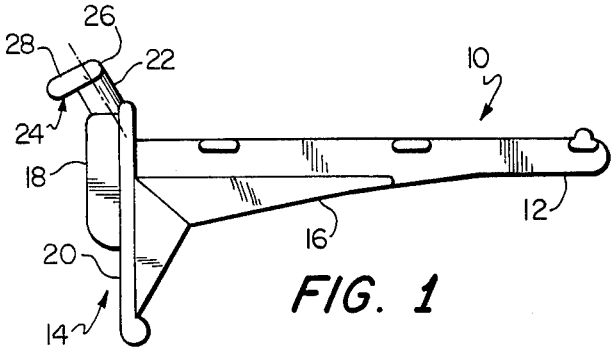
FIG. 1 is a side elevation of a bracket.
Figure 3:
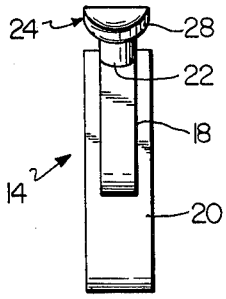
FIG. 3 is a rear elevation of the bracket of FIG. 1.
Figure 2:
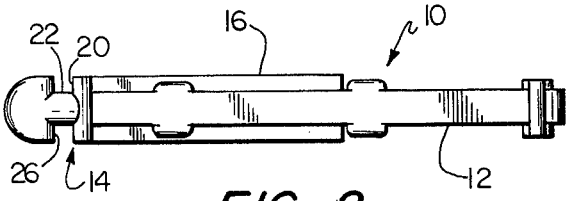
FIG. 2 is a top plan view of the bracket of FIG. 1.
Figure 6:
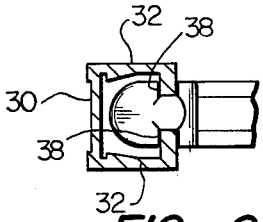
FIG. 6 is a top plan view taken in the direction of arrow VI in FIG. 5.

Referring firstly to FIGS. 1 to 3, the bracket 10 illustrated includes a horizontal portion 12 on the upper surface of which rests a shelf (not shown) or other element to be supported by the bracket. The horizontal portion 12 protrudes from a vertical portion generally indicated at 14, there being strengthening web 16 in the angle between these two portions. The web 16, in plan view, is wider where it joins the portion 12 than is the portion 12 itself (see FIG. 2) and extends over approximately half the length of the portion 12. The portion 14 is also wider than the portion 12 and is equal in width to the maximum width of the web 16.

A supporting block 18 protrudes rearwardly from the rear face of the portion 14. The block 18, in both height and width, is smaller than the rear face 20 and is positioned towards the top of this face.

A neck 22 of round cross section protrudes upwardly and rearwardly from the block 18, the diameter of the neck being equal to the width of the block. The longitudinal axis X of the neck (FIG. 1) is not at right angles to the upper surface of the portion 12 but lies at an angle of approximately 45 degrees with respect to it.

A locking formation 24 is provided at the upper end of the neck 22. The width of this formation (see FIG. 2) is greater than the diameter of the neck and is slightly less than the width of the Face 20. The formation 24 includes an integral cross bar 26 and supporting gusset 28, the gusset strengthening the cross bar to prevent fracturing thereof in use. The gusset is, in the illustrated embodiment, shown as being approximately semi-circular in plan view.

Figure 4:
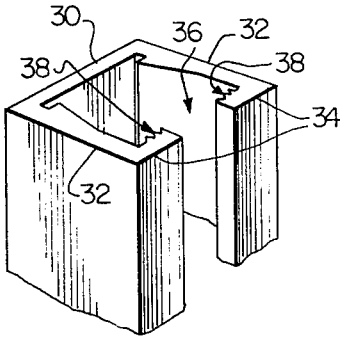
FIG. 4 is a pictorial view, to a larger scale, of a channel.

Turning now to FIG. 4, the channel illustrated is of constant cross-sectional shape and indefinite length. This channel comprises a web 30 and two flanges 32, the web and flanges being at right angles to one another. Lips 34, parallel to the web 30, extend towards one another from the free edges of the flanges 32. The lips 34 together define a mouth 36 and each is formed, on the surface thereof which faces the web 30, with longitudinally extending serrations 38. The serrations are of triangular cross-section thereby to provide readily deformable pointed peaks. Symmetrical serrations as illustrated are preferred but saw-tooth serrations can be used provided they have the required deformable peaks.

Figure 7:
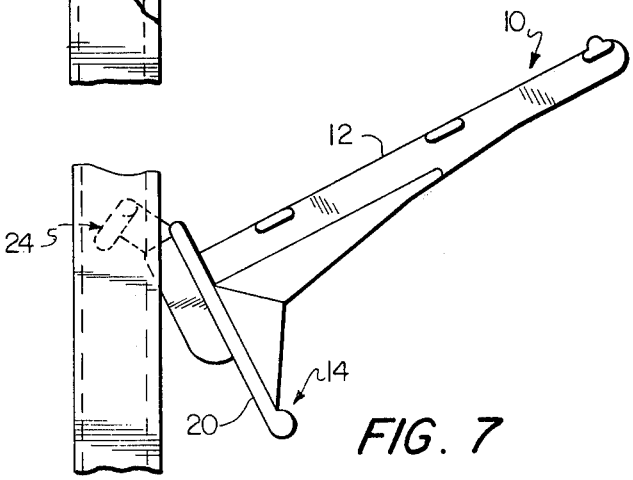
FIG. 7 illustrates the relationship between the bracket and channel when it is desired to move the bracket relative to the channel.

To mount the bracket on the channel, the formation 24 is entered into the cavity bounded by the web, flanges and lips of the channel. This can be achieved in two ways. Firstly, with the outer end of the bracket tilted upwardly as shown in FIG. 7, the formation 24 can be entered into the channel from one end thereof. While the width of the formation 24 exceeds the dimension of the mouth 36 between the lips 34, the diameter of the neck is less than this dimension. Thus, while the bracket is tilted to maintain the formation 24 away from the serrations 38, the bracket can be shifted freely with respect to the channel. Secondly, the bracket may be turned onto its side and presented to the vertically extending channel with the axis of the neck horizontal, ie with the bracket at right angles to the position shown in FIG. 7. The gusset 28 initially enters the mouth 36 and then, by pivoting the bracket about a vertical axis extending in the direction of elongation of the mouth 36, the entire formation 24 can be swung into the channel with the neck 32 passing through the mouth 36. The bracket is then rotated about a horizontal axis intersecting said vertical axis and passing centrally through the mouth 36 and web 30 until it reaches the position of FIG. 7 whereafter its outer end can be lowered to the position in FIG 5.

Figure 5:
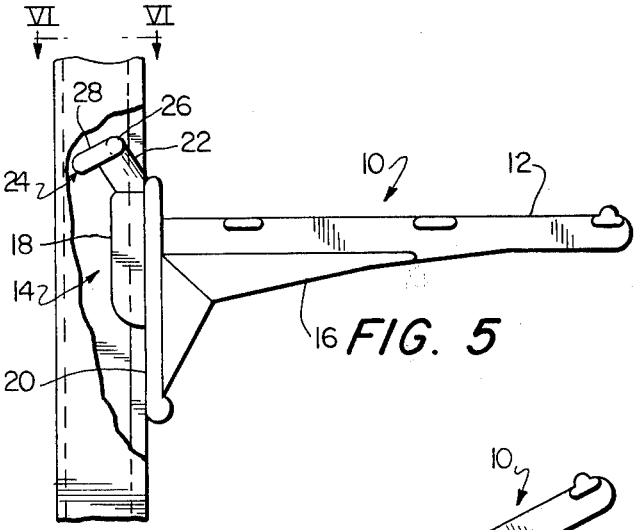
FIG. 5 is a side elevation, partly in section, showing the bracket mounted on the channel.

When the bracket is in the position shown in FIG. 5, the peaks of the serrations are deformed by pressure exerted thereon by the formation 24 so as positively to lock the bracket to the channel. As the force on the outer end of the bracket increases, the peaks are deformed still further due to the increase in the moment thrusting the formation 24 against the peaks. To ensure that the peaks are deformed, the thickness of each lip 34 measured from the peaks of its serrations to the outer face thereof is greater than the horizontal spacing between a vertical plane containing the surface 20 and a vertical plane containing the face of the cross bar 26 remote from the gusset 28.

The channel may be fixed to a wall or may form an upright of a furniture unit. In both cases it mounts one or more brackets 10 on which shelves or other elements are supported. In another embodiment, the channel forms part of a free standing pole having a central core with flanges radiating therefrom. Oppositely directed lips are provided at the outer, free end of each flange thereby to provide a circumferential array of mouths in which brackets can be entered. In yet another embodiment, the channel can be double-sided so as to support a bracket protruding in opposite directions therefrom.

The ability to use various shapes of channel stems from the fact that only the lips are involved in the locking action. Thus provided suitable serrated lips are incorporated, the remainder of the channel can have any shape that is required.

The embodiments of the invention in which an exclusive property or privilege is claimed are defined as follows:

1. A locking structure comprising
an element having
a web,
flanges extending from opposite ends of said web, and
a pair of laterally spaced, oppositely directed lips extending from said flanges which define a mouth therebetween, each of said lips having an inner face formed with longitudinally extending serrations and having an outer face; and
a bracket having
a main portion with an abutting surface,
a neck protruding from said main portion with one end coupled to said main portion and a free end remote from said main portion, said neck being dimensioned so it may pass through said mouth, and
a locking formation mounted on said free end of said neck and extending laterally from each side of said neck, the dimensions of said locking formation in a direction transverse of said neck being greater than the width of said mouth, said locking formation having an abutting face adapted to abut said serrations on said inner faces of said lips;
whereby, when said neck is located in said mouth and said bracket is located in position relative to said element, said abutting surface of said main portion is brought into abutting relationship with said outer face of said lips and said abutting face of said locking formation is brought into abutting relationship with said serrations on said inner faces of said lips.

2. A locking structure according to claim 1, wherein said main portion of said bracket has two limbs and is L-shaped, said abutting surface is an outwardly directed face of one of said limbs, and said neck extends obliquely from said abutting surface.

3. A locking structure according to claim 2, wherein a block extends outwardly from said abutting surface and said neck extends from one end of said block.

4. A locking structure according to claim 2, wherein a strengthening rib is located in an angle between said limbs and is integral with said limbs.

5. A locking structure according to claim 1, wherein the thickness of said lips measured from peaks of said serrations to said outer faces is greater than the horizontal spacing between a vertical plane containing said abutting surface of said main portion and a vertical plane containing said abutting face of said locking formation.

6. A locking structure according to claim 5, wherein said locking formation is spaced from said web when said locking formation and said main portion are in abutting relationship with said lips.

7. A locking structure comprising
an element having a pair of laterally spaced, oppositely directed lips which define a mouth therebetween, said lips having inner and outer faces, said inner faces having longitudinally extending serrations thereon; and
a bracket having a main portion with a surface adapted to abut said outer faces of said lips;
a neck protruding from said main portion with one end coupled to said main portion and a free end remote from said main portion, said neck being dimensioned so it may pass through said mouth, and
a locking formation mounted on said free end of said neck and extending laterally from each side of said neck, the dimensions of said locking formation in a direction transverse of said neck being greater than the width of said mouth, said locking formation having an abutting face adapted to abut said inner faces of said lips,
the thickness of said lips between said inner and outer faces being greater than the horizontal spacing between a vertical plane containing said surface of said main portion and a vertical plane containing said abutting face of said locking formation;
whereby said bracket and said element may be fixed relative to each other by entrapping said lips between said main portion surface and said locking formation abutting face.

8. A locking structure according to claim 7, wherein said neck extends obliquely from said surface of said main portion.

9. A locking structure according to claim 8, wherein a block extends outwardly from said surface and said neck extends from one end of said block.

* * * * *